United States Patent [19]

DeLuca

[11] 4,296,459

[45] Oct. 20, 1981

[54] LIGHT EMITTING ELECTRONIC JEWELRY

[76] Inventor: Frederick P. DeLuca, 3520 Jewel Dr., Ames, Iowa 50010

[21] Appl. No.: 64,036

[22] Filed: Aug. 6, 1979

[51] Int. Cl.[3] ..... F21L 15/08

[52] U.S. Cl. ..... 362/104; 362/32; 362/800

[58] Field of Search ..... 362/103, 104, 800, 32

[56] References Cited

U.S. PATENT DOCUMENTS

| | | | |
|---|---|---|---|
| 2,798,148 | 7/1957 | Di Lizio | 362/103 |
| 3,384,740 | 5/1968 | Wood | 362/104 |
| 3,737,647 | 6/1973 | Gomi | 362/104 |
| 3,968,357 | 7/1976 | Hamilton | 362/104 |
| 4,009,381 | 2/1977 | Schreiber | 362/32 |
| 4,170,036 | 10/1979 | Sussel | 362/104 |

*Primary Examiner*—Donald P. Walsh

*Attorney, Agent, or Firm*—Zarley, McKee, Thomte, Voorhees & Sease

[57] ABSTRACT

Light emitting electronic jewelry, an earring for example, includes an earring post having a light emitting diode supported thereon. The diode is connected in an electrical circuit including a battery means. In one form of the invention, the electrical circuit includes an integrated circuit and a capacitor electrically connected between the integrated circuit and light emitting diode such that the diode is caused to flash on and off. In another form of the invention, the electrical circuit includes a mercury switch electrically connected between the diode and battery so as to make and break the electrical connection therebetween in response to movements of the wearer. The battery and electrical circuit components may be supported within a casing suspended from the earring post.

6 Claims, 7 Drawing Figures

LIGHT EMITTING ELECTRONIC JEWELRY

BACKGROUND OF THE INVENTION

The present invention relates to electronic jewelry and more particularly to jewelry including a light emitting diode and an electrical circuit for illuminating the same.

Earrings including electrical light sources have previously been devised but to the best of applicant's knowledge, they all suffer certain disadvantages. The light source in the form of a conventional light bulb may necessarily be so large or bright as to have a strikingly artificial appearance. Similarly, when such a light source is illuminated continuously, the sparkle effect associated with jewelry is not achieved. Finally, those devices which do provide for the light source to be turned on and off depend upon a movable mechanical switch means which is subject to the usual problems of corrosion, wear and electrode buildups associated with mechanical contacts.

Accordingly, a primary object of the present invention is to provide an improved light emitting electronic jewelry piece.

A further object is to provide an electronic jewelry piece including a light emitting diode.

Another object is to provide an electronic jewelry piece including a light source which flashes on and off to simulate the sparkle of light associated with fine jewels.

Another object is to provide a light emitting electronic jewelry piece wherein the flashing of the light source is not dependant upon mechanical switching contacts.

Another object is to provide an electronic jewelry piece wherein the light source is flashed on and off in response to movements of the wearer.

Finally, another object is to provide a light emitting electronic jewelry piece which is economical to manufacture, efficient in operation and refined in appearance.

SUMMARY OF THE INVENTION

The light emitting electronic jewelry piece of the present invention, with particular reference to an earring, includes an earring post adapted for securement to a wearer's earlobe and having a light emitting diode supported on the post. The diode is connected in an electrical circuit with a battery such that the diode is illuminated at times by the battery. In one form of the invention, the electrical circuit includes an integrated circuit to which the battery and light emitting diode are connected and a capacitor connected between the integrated circuit and diode such that the light emitting diode is caused to flash on and off. In an alternate form of the invention, the electrical circuit includes a mercury switch electrically connected between the diode and battery so as to make and break the electrical connection therebetween in response to movements of the wearer's earlobe. The diode may be connected to the earring post with the other elements of the electrical circuit supported in a casing suspended from the post by conductors leading to the diode. The integrated circuit is particularly adapted for varying the flashing rate of the diode to effect a gem-like sparkle or such other illumination as desired.

DESCRIPTION OF THE PREFERRED EMBODIMENTS

Figure 1:
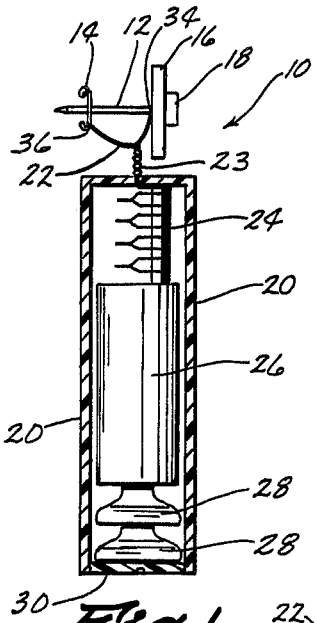
FIG. 1 is a transverse sectional view of a light emitting electronic earring of the invention.

A light emitting electronic earring 10 of the present invention is shown in FIG. 1 as including a pierced earring post 12 having a conventional clasp 14 slidably fitted on the interior end thereof and an ornament 16 secured on the exterior end thereof. A light emitting diode 18 (LED) is supported on the ornament so as to be readily visible when the earring is being worn. An elongated cylindrical casing 20 is suspended from the earring post 12 by a 2-wire cable 22 and conductor chains 23 which connect the light emitting diode to electrical circuit components within the casing. These components include an integrated circuit 24, a capacitor 26 and a pair of disc shaped batteries 28. The casing preferably has one end 30 which is snap fit or otherwise removably secured in place to provide the insertion and retention of the electrical components therein.

Figure 2:
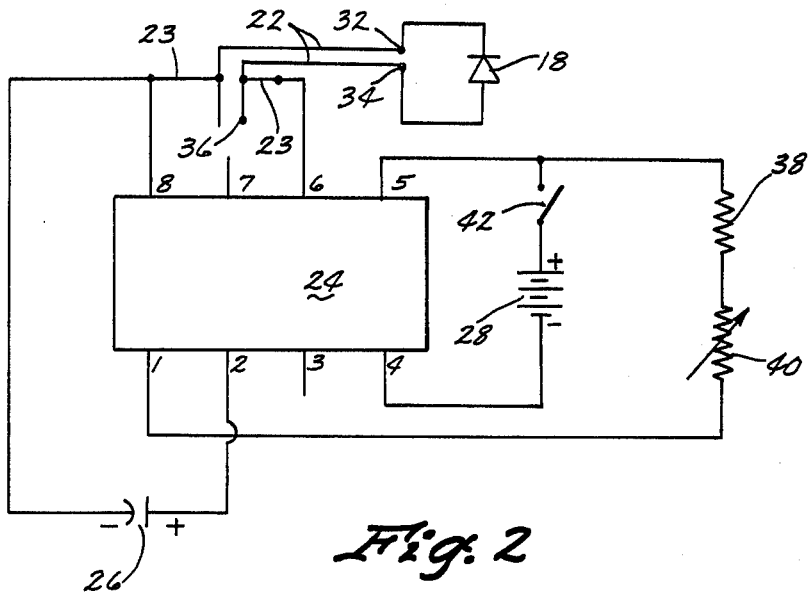
FIG. 2 is a schematic electrical circuit diagram for the earring of FIG. 1.

Referring to the schematic circuit diagram of FIG. 2, integrated circuit 24 is of the type that is designated LM3909 having contact pins designated 1 through 8. Diode 18 is electrically connected between pins 6 and 8 of integrated circuit 24 by conductors including the wires of 2-wire cable 22 and the conductor chains 23 as shown. Capacitor 26 is electrically connected between pins 2 and 8 of the integrated circuit and battery 28 is electrically connected between pins 4 and 5. A standard resistor 38 and variable resistor 40 are connected in series between pins 1 and 5 of integrated circuit 24 as shown. Finally, an on-off switch 42 is connected in series with the battery 28 to eliminate current drain when the earring is not in use.

The suspension technique for the power pack casing 20 thus includes a pair of conductor chains 23 which each clip onto a medial portion of a respective wire of 2-wire cable 22. Diode 18 is electrically connected between the wires at one end of the cable as indicated by contact points 32 and 34. Physical support is provided by the connection of one wire of cable 22 to the post 12 at contact point 34 and to the clasp or ear back 14 at contact point 36.

Figure 3:
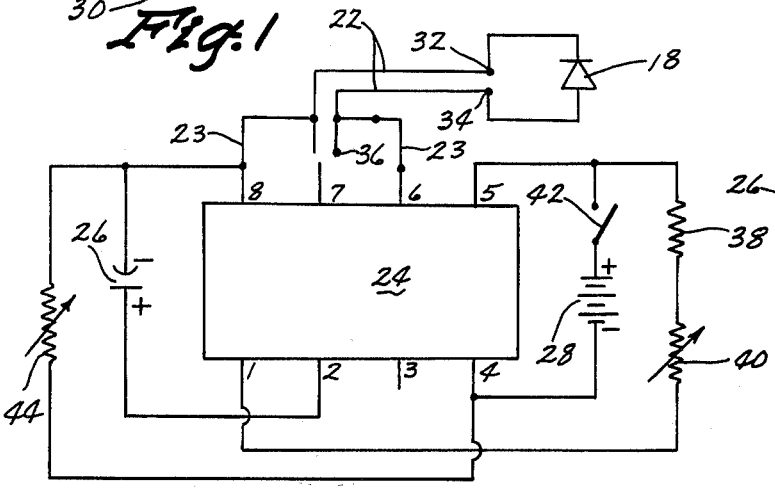
FIG. 3 is an alternate schematic electrical circuit diagram for the invention.

An alternate circuit diagram for the earring 10 is shown in FIG. 3 wherein like elements are designated by the same reference numerals used in FIG. 2. The basic difference is that another variable resistor 44 has been electrically connected between pins 4 and 8. Accordingly, the flashing rate of the light emitting diode 18 may be varied by several different means in the circuit of FIG. 3. The flashing rate can be changed by varying the resistance and/or capacitance in the electrical circuit to thereby vary the charge and discharge times. In addition or alternatively, the positive and negative bias on certain circuits may be controlled through the use of a resistance type voltage divider network.

Figure 4:
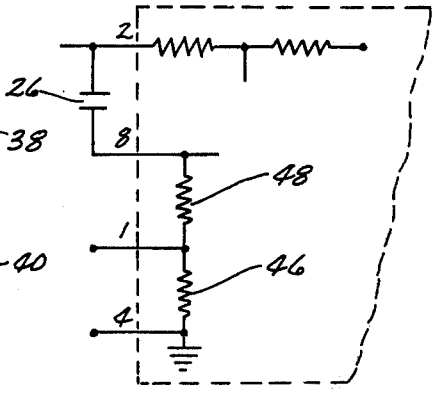
FIG. 4 is a schematic electrical circuit diagram of a portion of the integrated circuit of the invention.

Specifically, with a 390 mf capacitor provided at 26 and resistors 38 and 40 rated at 1.5 k ohms and 5.0 k ohms respectively, the variable resistor 40 may be adjusted to vary the flashing rate from one flash per two seconds to approximately one flash per twenty-five seconds. Resistors 38 and 40 operate to increase the positive voltage bias on a 3 k ohm resistor 46 in the integrated circuit 24 as shown in the partial circuit diagram of FIG. 4. As resistor 40 decreases in resistance, positive voltage on the internal resistor 46 increases and retards the charging current to capacitor 26. Note that the connection on pin 1 can be moved to pin 8 with the same effect and less current drain. The above is an example of using a biasing technique to control the flashing.

An alternate means for varying the flashing rate is provided by resistor 44. With that resistor rated at 50.0 k ohms, the resistance thereof may be decreased to increase the flashing rate from about one flash per two seconds to more than a few thousand flashes per second, at which point the diode 18 is practically continuous or it flickers slightly. Resistor 44 is connected in parallel with internal resistor 46 and another 6 k ohm internal resistor 48 and operates to reduce the resistance in the charging path of capacitor 26.

Finally, the flashing rate can also be controlled by the electrical size of capacitor 26. As the electrical size increases, charge time increases and the flashing rate decreases. The physical size of the capacitor 26 is a limitation in the sense that generally the physical size increases with the electrical size or rating. A practical size for capacitor 26 is between 300 micro-farads and 470 micro-farads but larger values may be possible if physical size is not excessive.

Figure 5:
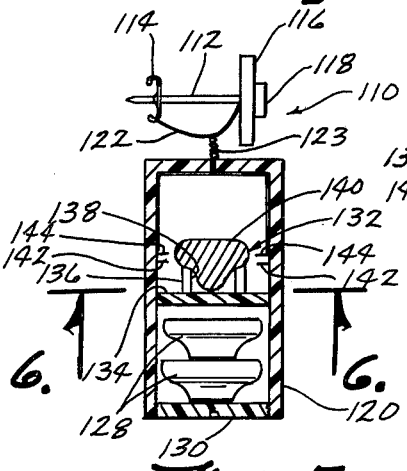
FIG. 5 is a transverse sectional view of an alternate embodiment of the invention.
Figure 6:
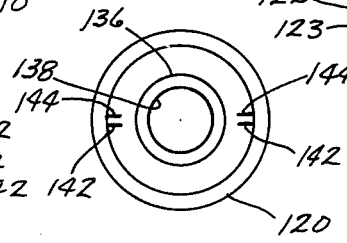
FIG. 6 is a top sectional view taken along line 6—6 in FIG. 5.

An alternate embodiment of the invention is shown in FIG. 5 wherein an earring 110 includes a pierced earring post 112 having a clasp 114 on one end and an ornament 116 secured on the exterior end. A light emitting diode 118 is secured to the ornament 116 so as to be readily visible when the earring is being worn. A casing 120 is suspended from the post 112 by a 2-wire cable 122 and a pair of conducting chains 123. Casing 120 houses a pair of disc batteries 128 as in the previous embodiment. Likewise, one end 130 may be removable to provide for the insertion and retention of electrical components therein. Also housed within casing 120 is a mercury switch 132.

Figure 7:
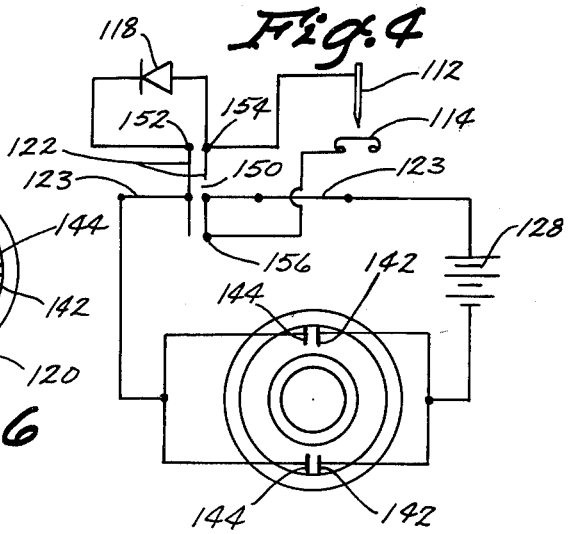
FIG. 7 is a schematic electrical circuit diagram for the earring of FIG. 5.

Mercury switch 132 includes a support surface 134 secured to the casing 120 so as to be situated horizontally when the earring is stationary. An annular insulator 136 having a vertical opening 138 therethrough is generally centrally mounted on support surface 134 to position a quantity of liquid mercury 140 thereon. A first set of electrical contacts 142 is arranged in circumferentially spaced apart relation about the periphery of casing 120 and connected on one side of the battery 128. Another set of contacts 144 are arranged in closely spaced relation to respective contacts 142 with both sets of contacts being in clearance relation from the liquid mercury 140 when the same is at rest. However, when the support surface 134 is inclined toward a pair of contacts 142 and 144 in response to normal movements of the wearer, an electrical connection is established between said contacts. With reference to the circuit diagram of FIG. 7, it is seen that contacts 144 are electrically connected to one side of the diode 118, the other side of which is connected to the battery 128 with a novel on-off switch interposed therebetween.

The novel on-off switch of this embodiment is operated by engagement and disengagement of the clasp or ear back 114 on the earring post 112. Note that one wire of 2-wire cable has a gap at 150 and opposite ends 154 and 156 electrically connected to post 112 and clasp 114 respectively. Accordingly, an electrical connection between the diode 118 and battery 128 is made only when clasp 114 is engaged on the post 112.

This alternate embodiment eliminates the need for the integrated circuit and capacitor of the previous embodiment and enables the size of the casing 120 to be made substantially smaller. In addition, the irregular flashing that results from movements of the wearer is more like the sparkle of light from diamond jewelry.

Experimentation has indicated that the use of rhinestones enhances the sparkle of light from the light emitting diode. The combination of the rhine-stone effect and the diode can be brought about much easier if the rhine-stones are built into the face of the diode during the manufacturing process. For example, light emitting diodes can be fitted with different cuts of glass, diamond or simulated diamond in such shapes as emerald, marquise, pear, round or any other shape. In this way, the light emitting diodes are particularly suited for use in jewelry.

It is to be understood that the light emitting electronic jewelry of the present invention is not limited to earrings but may be equally adaptable to such other items as necklaces, bracelets, rings etc.

Thus there has been shown and described light emitting electronic jewelry pieces which accomplish at least all of the stated objects.

I claim:

1. A light emitting electronic earring comprising, an earring post adapted for securement to a wearer's earlobe, a light emitting diode operatively supported on said post, a battery means, and an electrical circuit, said light emitting diode and battery means being electrically connected in said circuit such that said light emitting diode is illuminated at times by said battery means, said electrical circuit comprising a mercury switch electrically connected between said light emitting diode and battery means so as to make and break the electrical connection therebetween in response to movements of the wearer's earlobe, a casing, said battery means and mercury switch being supported in said casing, said electrical circuit including elongated conductor chains electrically connecting said light emitting diode to said mercury switch, said casing being suspended from said post by said conductor chains.

2. The earring of claim 1 further comprising a clasp removably engageable on said post, one of said conductor chains being discontinuous and having a first portion electrically connected to said post and a second portion electrically connected to said clasp whereby said post and clasp are operative as an on-off switch for said light emitting diode.

3. The earring of claim 1 wherein said first contact and said other contact are arranged in closely spaced relation as a pair of contacts and further comprising a plurality of said pairs of contacts disposed in spaced apart relation about the periphery of said insulator.

4. The earring of claim 1 wherein said quantity of liquid mercury is disposed in clearance relation from said contacts when said surface is horizontally disposed, thereby effecting a normally off condition for said mercury switch.

5. The earring of claim 1 wherein said earring post is of the pierced earring type and has interior and exterior ends, said light emitting diode being supported on said exterior end.

6. The earring of claim 1 wherein said mercury switch comprises a support surface within said casing, a first contact electrically connected to one of said battery means and said light emitting diode and disposed adjacent said support surface, at least one other contact electrically connected to the other of said battery means and light emitting diode and disposed adjacent said support surface, and a quantity of liquid mercury supported on said surface within said casing for electrically connecting said contacts when support surface is inclined toward said contacts.

* * * * *